US009267358B2

(12) United States Patent
Parsche

(10) Patent No.: US 9,267,358 B2
(45) Date of Patent: Feb. 23, 2016

(54) HYDROCARBON RECOVERY SYSTEM USING RF ENERGY TO HEAT STEAM WITHIN AN INJECTOR AND ASSOCIATED METHODS

(71) Applicant: Harris Corporation, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 321 days.

(21) Appl. No.: 13/940,551

(22) Filed: Jul. 12, 2013

(65) Prior Publication Data

US 2015/0013979 A1 Jan. 15, 2015

(51) Int. Cl.
*E21B 43/24* (2006.01)
*E21B 36/00* (2006.01)

(52) U.S. Cl.
CPC ..... *E21B 36/00* (2013.01); *E21B 43/2401* (2013.01); *E21B 43/2408* (2013.01); *H05B 2214/03* (2013.01)

(58) Field of Classification Search
CPC ..... E21B 36/00; E21B 43/24; E21B 43/2401; E21B 43/2406; E21B 43/2408; H05B 2214/03; H05B 6/00
See application file for complete search history.

(56) References Cited

U.S. PATENT DOCUMENTS

| | | | | |
|---|---|---|---|---|
| 4,398,076 | A | 8/1983 | Hanson | |
| 7,028,623 | B1 | 4/2006 | Pearson | |
| 2009/0321132 | A1 * | 12/2009 | Ouellet et al. | 175/11 |
| 2010/0078163 | A1 * | 4/2010 | Banerjee et al. | 166/248 |
| 2010/0108318 | A1 * | 5/2010 | Diehl et al. | 166/272.3 |
| 2010/0294489 | A1 * | 11/2010 | Dreher et al. | 166/248 |
| 2010/0294490 | A1 | 11/2010 | Banerjee et al. | |
| 2012/0067572 | A1 * | 3/2012 | Trautman et al. | 166/272.3 |
| 2012/0067580 | A1 * | 3/2012 | Parsche | 166/302 |
| 2012/0085533 | A1 | 4/2012 | Madison et al. | |
| 2012/0247760 | A1 | 10/2012 | Wheeler et al. | |
| 2014/0110103 | A1 * | 4/2014 | Hyde et al. | 166/248 |

* cited by examiner

*Primary Examiner* — Robert E Fuller
*Assistant Examiner* — Christopher Sebesta
(74) *Attorney, Agent, or Firm* — Allen, Dyer, Doppelt, Milbrath & Gilchrist, P.A.

(57) ABSTRACT

A hydrocarbon resource recovery system is provided for a subterranean formation having an injector wellbore and a producer wellbore therein. The hydrocarbon resource recovery system includes a tubular producer positioned in the producer wellbore and a tubular injector positioned in the injector wellbore. A steam source is coupled to a proximal end of the tubular injector, and a radio frequency (RF) energy source is coupled to the proximal end of tubular injector. The tubular injector has spaced apart steam injector slots sized to allow steam to pass into the subterranean formation, while containing RF energy within the tubular injector to heat the steam.

18 Claims, 7 Drawing Sheets

HYDROCARBON RECOVERY SYSTEM USING RF ENERGY TO HEAT STEAM WITHIN AN INJECTOR AND ASSOCIATED METHODS

FIELD OF THE INVENTION

The present invention relates to the field of oil resources, and more particularly, to a recovery system for recovering hydrocarbons from a subterranean formation, and associated methods.

BACKGROUND OF THE INVENTION

The production of heavy oil and bitumen from subsurface reservoirs, such as oil sands or shale oil, is challenging. One of the main reasons for the difficulty is the viscosity of the heavy oil or bitumen in the reservoir. At reservoir temperature the initial viscosity of the oil is such that it is difficult to produce if not mobilized using external heat. As a result, the removal of oil from the reservoir is typically achieved by introducing sufficient energy into the reservoir, such that the viscosity of the oil is reduced sufficiently to facilitate oil production.

An in situ extraction known as Steam-Assisted Gravity Drainage (SAGD) may be used for extracting oil sand or shale oil deposits. The heavy oil is immobile at reservoir temperatures, and therefore, the oil is typically heated to reduce its viscosity and mobilize the oil flow. In SAGD, pairs of injector and producer wellbores are formed to be laterally extending in the ground, where an injector is positioned in the injector wellbore and a producer is positioned in the producer wellbore.

As illustrated in FIG. 1, the injector 10 is used to typically inject steam 12, and the producer 20 collects the heated crude oil or bitumen 22 that flows out of the formation 30, along with any water from the condensation of the injected steam. The injected steam 12 forms a steam chamber 14 that expands vertically and horizontally in the formation 30. The heat from the steam 12 reduces the viscosity of the heavy crude oil or bitumen 22, which allows it to flow down into the producer 20 where it is collected and recovered. The steam rises due to its low density. Oil and water flow is by gravity driven drainage urged into the producer 20.

A problem may arise in maintaining thermal efficiency of the steam 12 throughout the length of the injector 10, and into the steam chamber 14 that expands vertically and horizontally in the subterranean formation 30. Typically, the steam 12 condenses at the far end of the injector 10. Dry steam may be available up hole and wet steam down hole, such that steam enthalpy diminishes with well length. This means that the oil sand or shale oil deposits at the far, down hole end of the injector 10 may not be extracted.

To address this problem, non-condensable gases may be co-injected with the steam. For example, U.S. Published Patent Application No. 2012/0247760 discloses co-injecting steam with non-condensable gases such as $C_{O2}$, flue or combustion gases, and light hydrocarbons. The non-condensable gases provide an insulating layer at the top of the steam chamber, resulting in higher thermal efficiency.

Another approach to maintain thermal efficiency of the steam throughout the injector, and into the steam chamber, is to co-inject microwave energy absorbing substances with the steam, as disclosed in U.S. Published Patent Application No. 2010/0294490. As the steam and microwave energy absorbing substances expand throughout the steam chamber, radio frequency (RF) energy is used to target the microwave energy absorbing substances. The RF energy interacts with the microwave energy absorbing substances through a coupling phenomenon. The microwave energy absorbing substances are exposed to an alternating electric field which causes the microwave energy absorbing substances to rotate or reorient in order to follow the electromagnetic (EM) field of the RF energy source, and thereby couple with, or absorb, the RF energy. Sustained reorienting of neighboring molecules, as well as different orientations of dipole moments due to changing of the EM field, generate heat.

Even in view of the above approaches, there is still a need to improve the efficiency or quality of the steam throughout the length of the injector, and into the steam chamber that expands in the subterranean formation.

SUMMARY OF THE INVENTION

In view of the foregoing background, it is therefore an object of the present invention to improve the efficiency or quality of steam used in a hydrocarbon resource recovery system. In specific, steam quality is to be maintained throughout a steam injection well.

This and other objects, features, and advantages in accordance with the present invention are provided by a hydrocarbon resource recovery system for a subterranean formation having an injector wellbore and a producer wellbore therein. The hydrocarbon resource recovery system may comprise a tubular producer positioned in the producer wellbore, and a tubular injector positioned in the injector wellbore. A steam source may be coupled to a proximal end of the tubular injector. A radio frequency (RF) energy source may be coupled to the proximal end of the tubular injector. The tubular injector may have a plurality of spaced apart steam injector slots sized to allow steam to pass into the subterranean formation, while containing RF energy within the tubular injector to heat the steam. This feature provides for more efficient heating of the steam by the RF energy.

The tubular injector advantageously becomes a waveguide for the RF energy as well as a conduit for the steam. As the steam starts to condense and form water vapor clouds within the tubular injector, the RF energy heats the condensing water to significantly reduce or prevent condensation. The thermal quality of the steam at the far end of the tubular injector is increased. This improves the recovery of hydrocarbons in the subterranean formation, particularly at the far end of the tubular injector.

The RF energy source may comprise first and second magnetrons to generate circularly polarized RF energy. A coupling arrangement may be between the first and second magnetrons and the proximal end of the tubular injector. The proximal end of the tubular injector may be circular, and the coupling arrangement may comprise a circular-to-rectangular transition having a circular opening coupled to the circular proximal end of the tubular injector, and a rectangular opening.

A rectangular waveguide having a distal end may be coupled to the rectangular opening of the circular-to-rectangular transition, and a proximal end may be coupled to the first magnetron. A first hybrid coupler may be between the steam source and the rectangular waveguide adjacent the distal end thereof, and a second hybrid coupler may be between the second magnetron and the rectangular waveguide adjacent the proximal end thereof. The coupling arrangement may further comprise a pressure bulkhead within the rectangular waveguide between the first and second hybrid couplers.

The RF energy source may have an operating frequency within a range of 400 MHz to 24 GHz, for example. The RF energy source may have an operating wavelength A, and each of the steam injector slots may have a length within a range of 0.001λ to 0.10λ. This advantageously allows the slots to be sized to allow the steam to pass into the subterranean formation, while containing the RF energy within the tubular injector 10 to heat the steam as it condenses.

Another aspect is directed to method for hydrocarbon resource recovery in a subterranean formation having an injector wellbore and a producer wellbore therein. The method may comprise positioning a tubular injector in the injector wellbore, with the tubular injector having a plurality of spaced apart steam injector slots therein. Steam may be supplied into a proximal end of the tubular injector. RF energy may be supplied into the proximal end of tubular injector, and with the plurality of spaced apart steam injector slots being sized to allow steam to pass into the subterranean formation, while containing RF energy within the tubular injector, the steam is heated. Hydrocarbon resources may then be produced from the producer wellbore.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 3:
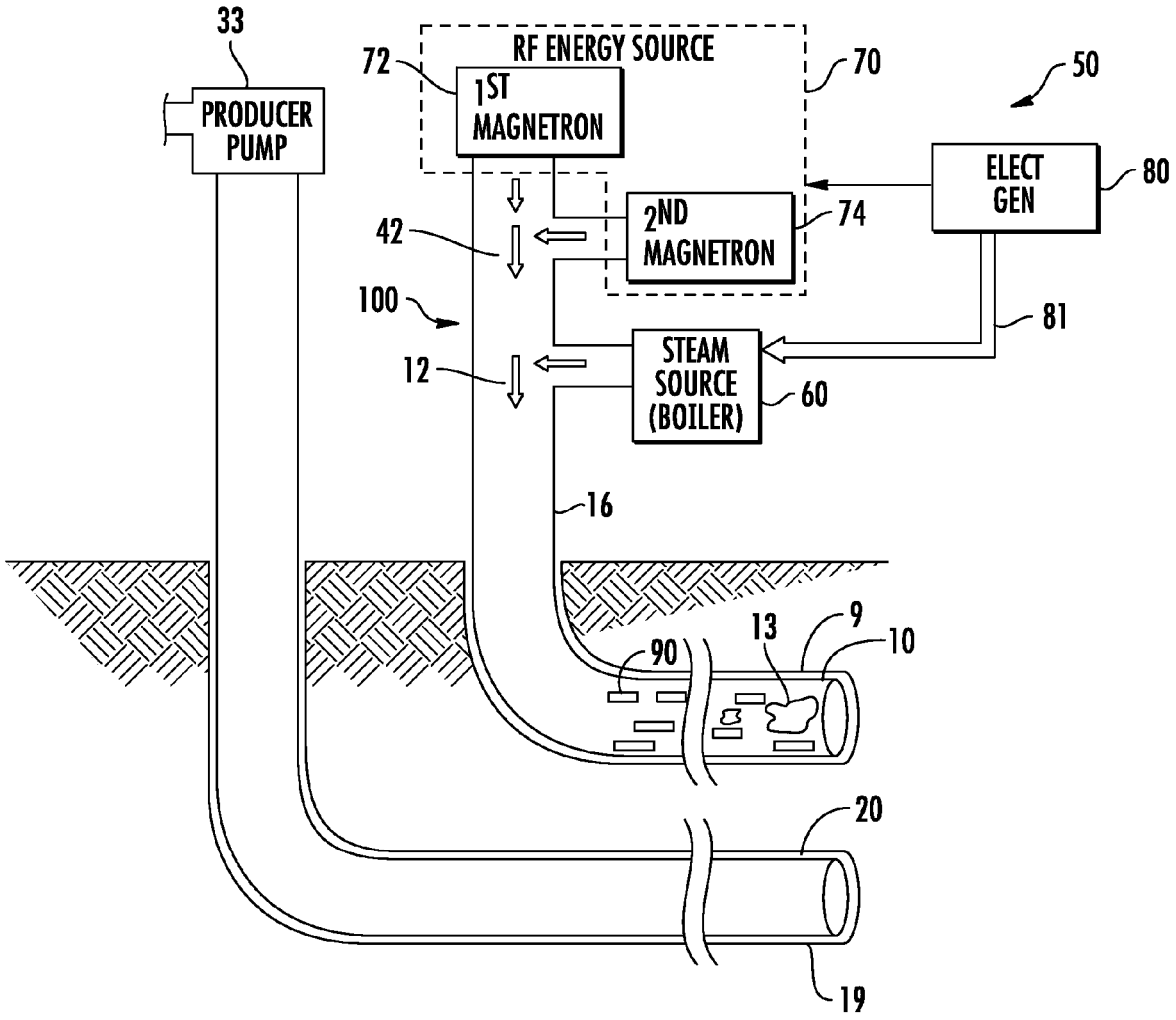
FIG. 3 is a block diagram of a hydrocarbon resource recovery system using RF energy to heat steam within a tubular injector in accordance with the present invention.

Referring now to FIG. 3, a hydrocarbon resource recovery system 50 using radio frequency (RF) energy 42 to heat steam 12 within an injector 10 will be discussed. As will be explained in greater detail below, the RF energy 42 remains within the injector 10 and prevents the steam 12 from condensing 13 therein. This allows the quality of steam 12 to be consistent throughout the entire injector 10 so that the crude oil or bitumen 22 at the far end of the injector will be sufficiently heated so as to be recovered by the producer 20.

Figure 1:
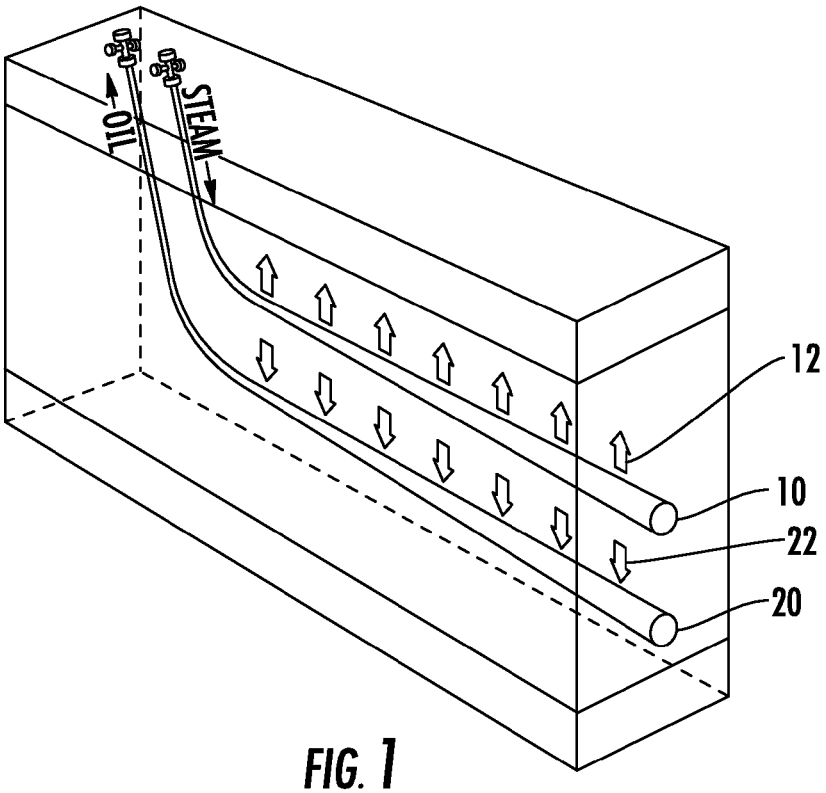
FIG. 1 (PRIOR ART)
FIG. 1 is a side perspective view of a Steam-Assisted Gravity Drainage (SAGD) hydrocarbon resource recovery system for a subterranean formation in accordance with the prior art.
Figure 2:
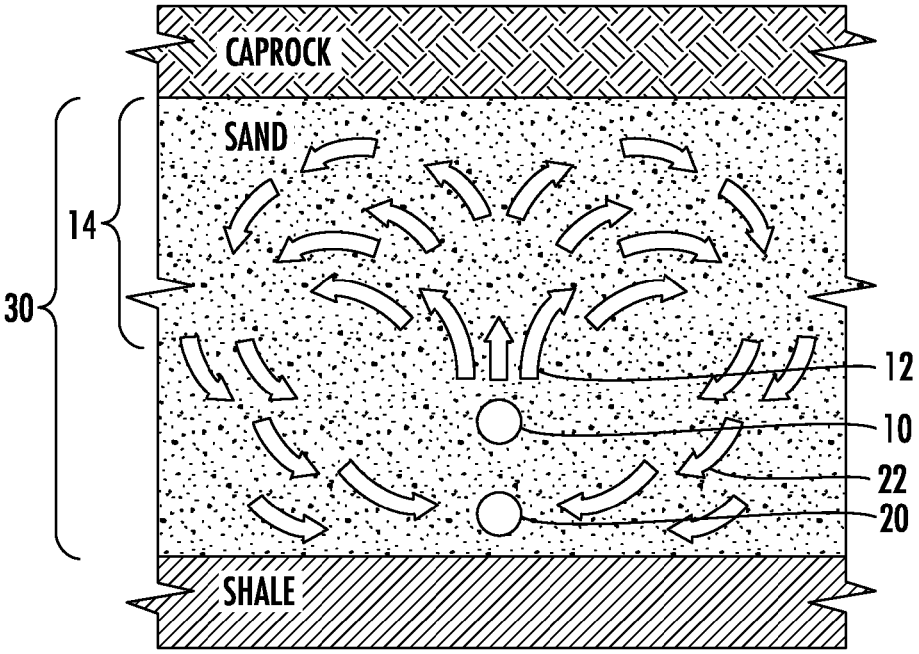
FIG. 2 (PRIOR ART)
FIG. 2 is an end view of the SAGD hydrocarbon resource recovery system shown in FIG. 1 illustrating injected steam reducing the viscosity of heavy crude oil or bitumen in the subterranean formation.

As discussed above in reference to FIGS. 1 and 2, the illustrated hydrocarbon resource recovery system 50 is for a subterranean formation 30 having an injector wellbore 9 and a producer wellbore 19 therein, and is known as a Steam-Assisted Gravity Drainage (SAGO) system. A tubular producer 20 is positioned in the producer wellbore 19, and a tubular injector 10 is positioned in the injector wellbore 9. A steam source 60 is coupled to a proximal end 16 of the tubular injector 10, and an RF energy source 70 is also coupled to the proximal end 16 of the tubular injector 10. The tubular injector 10 has a plurality of spaced apart steam injector slots 90 sized to allow steam 12 to pass into the subterranean formation 30, while containing the RF energy 42 within the tubular injector to heat the steam as it condenses.

Still referring to FIG. 3, the RF energy source 70 includes an electrical generator 80 coupled thereto, and the steam source 60 may include a boiler, for example. The electrical generator 80 may be a diesel generator that is cooled by water, for example. The cooling water may then be circulated via a pipeline 81 to the boiler 60 to supply waste heat thereto to increase overall energy efficiency. A producer pump 33 is coupled to the tubular producer 20.

Figure 4:
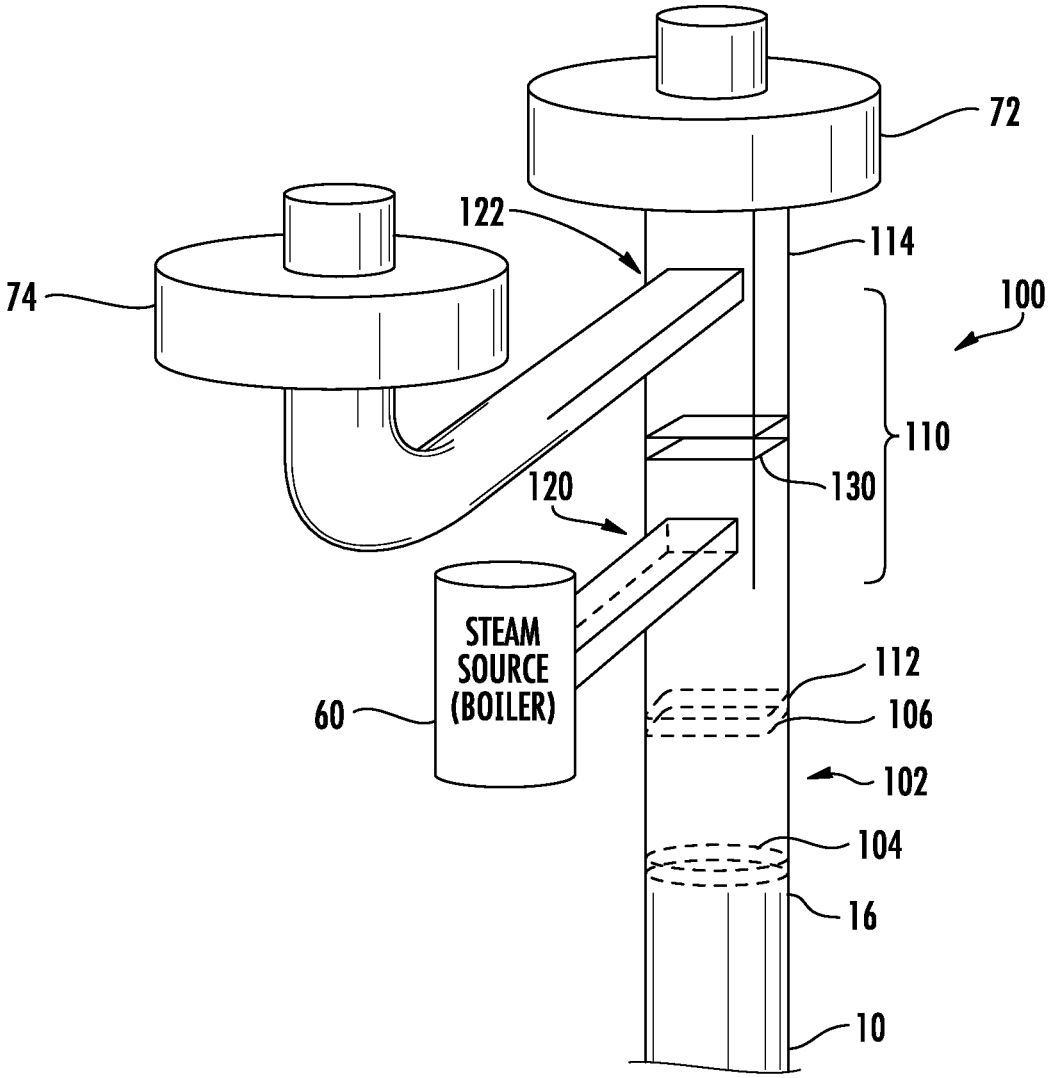
FIG. 4 is a more detailed perspective view the coupling arrangement coupled to the tubular injector as shown in FIG. 3.

The RF energy source 70 is configured to generate circularly polarized RF energy 42, and includes a first magnetron 72 and a second magnetron 74. As best illustrated in FIG. 4, a coupling arrangement 100 is between the first and second magnetrons 72, 74 and the proximal end 16 of the tubular injector 10. The proximal end 16 of the tubular injector 10 is circular, and the coupling arrangement 100 includes a circular-to-rectangular transition 102. The circular-to-rectangular transition 102 has a circular opening 104 coupled to the circular proximal end 16 of the tubular injector 10, and a rectangular opening 106.

The coupling arrangement 100 further includes a rectangular waveguide 110 having a distal end 112 coupled to the rectangular opening 106 of the circular-to-rectangular transition 102, and a proximal end 114 coupled to the first magnetron 72. A first hybrid coupler 120 is between the steam source 60 and the rectangular waveguide 110 adjacent the distal end 112 thereof. A second hybrid coupler 122 is between the second magnetron 74 and the rectangular waveguide 110 adjacent the proximal end 114 thereof. As background, hybrid couplers can isolate, sort and separate the directions the microwave energy will flow.

The second hybrid coupler 122 allows the first and second magnetrons 72, 74 to be combined without them interfering with one another as will be appreciated by those skilled in the art. Similarly, the first hybrid coupler 120 prevents the RF energy 42 from the first and second magnetrons 72, 74 from entering into the steam source 60. As also appreciated by those skilled in the art, the first and second hybrid couplers 120, 122 are also known as magic T couplers. A pressure bulkhead 130 is positioned within the rectangular waveguide 110 between the first and second hybrid couplers 120, 122.

Figure 6:
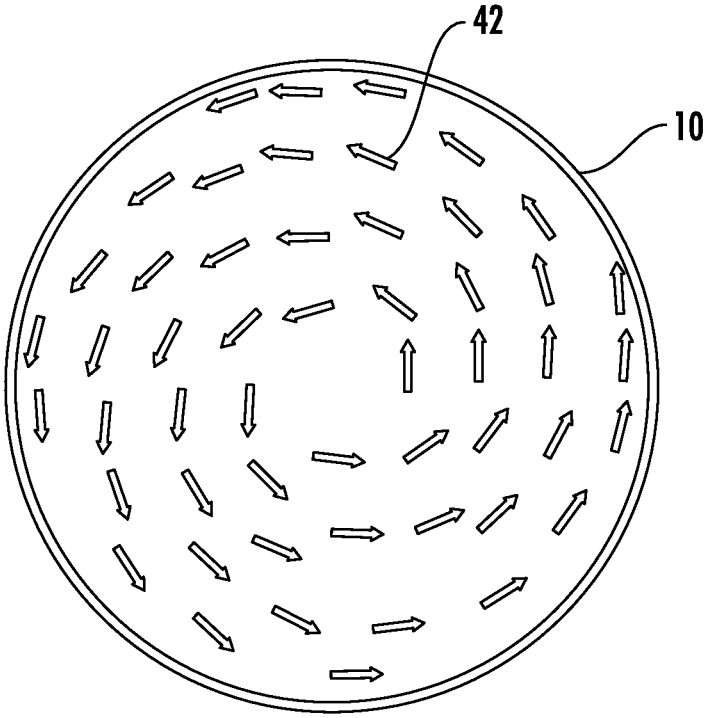
FIG. 6 is a schematic representation of the RE energy shown in FIG. 5 being circularly polarized for heating the condensed steam.
Figure 7:
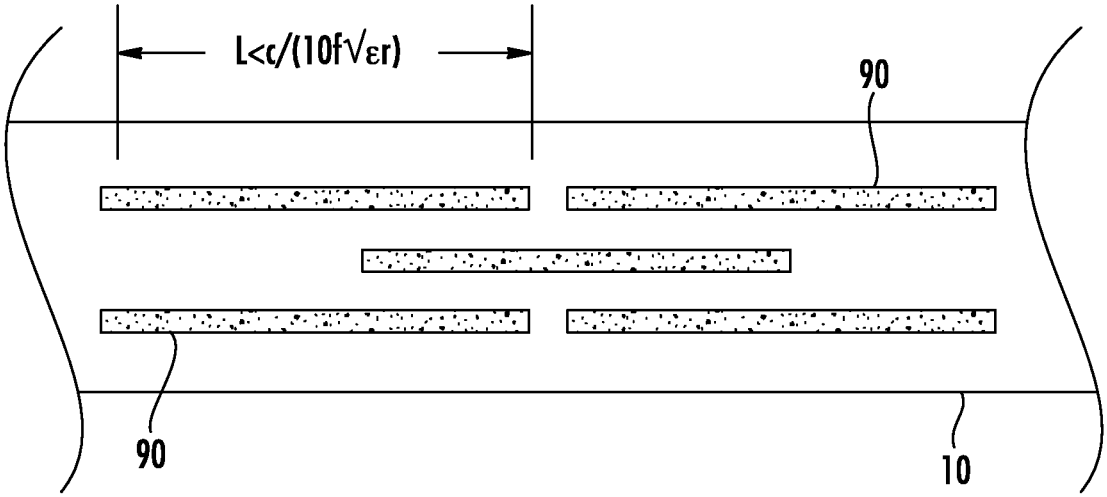
FIG. 7 is a schematic representation of the steam injector slots in the tubular injector in accordance with the present invention.

The RF energy source 70 is configured to generate circularly polarized RF energy as indicated by arrows 42 in FIG. 6. The operating frequency of the first and second magnetrons 72, 74 may be within a range of 400 MHz to 24 GHz, for example. The operating frequency of 24 GHz is known as the Debye frequency, which is the resonant frequency of water. Condensation and moisture is very receptive to RF heating at this frequency.

The tubular injector 10 may be about ¼ to 1 kilometer long, for example. The power of the RF energy source 70 is about 100 kilowatts into the tubular injector 10. The length of tubular injector 10 and the power of the first and second magnetrons 72, 74 will vary depending on the particular application.

Figure 5:
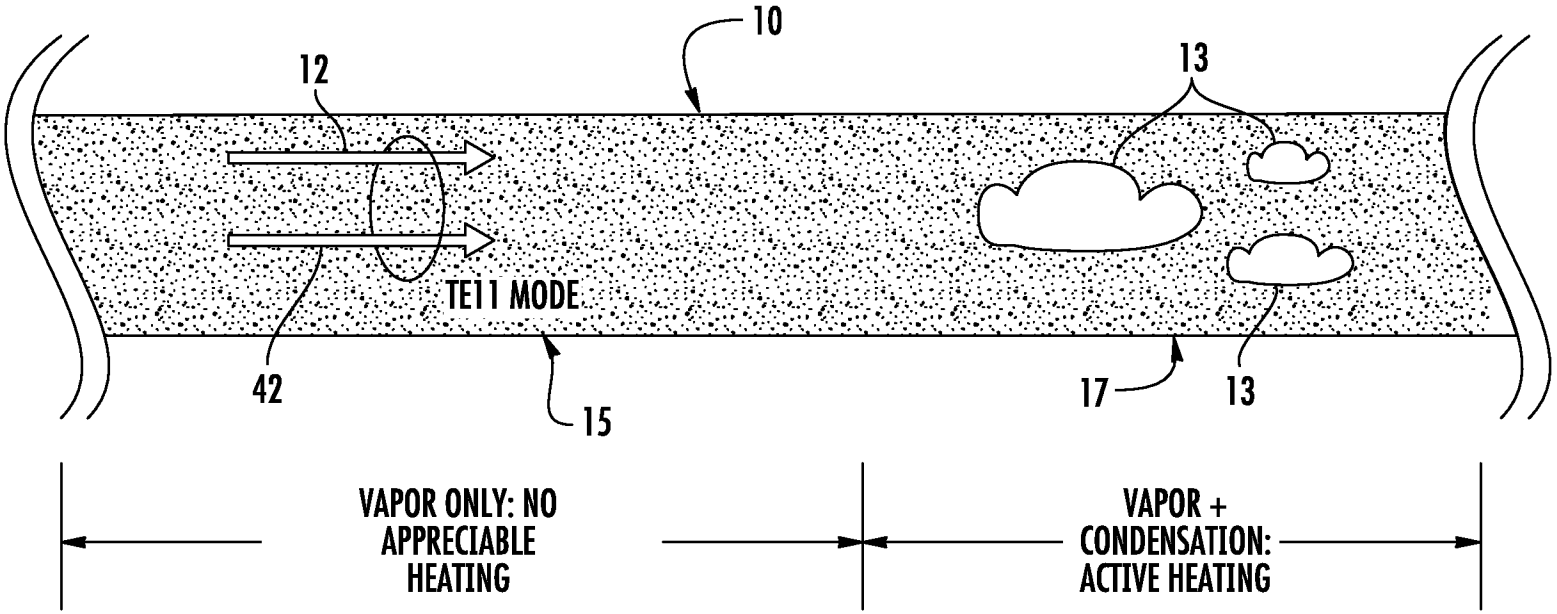
FIG. 5 is a schematic view of the tubular injector with RF energy and condensed steam therein in accordance with the present invention.

The steam enthalpy or heat donating content of the steam 12 is increased by the electromagnetic heating provided by the first and second magnetrons 72, 74. The electromagnetic heating mode is dielectric heating, as readily appreciated by those skilled in the art. The tubular injector 10 advantageously forms a $TE_{11}$ mode waveguide where the electromagnetic fields are stirred by circular polarization, as illustrated in FIGS. 5 and 6.

Water is a polar molecule. When an electric field is applied to a water molecule, it will react by aligning itself. Since $H_2O$ is not a symmetric molecule, the water molecules align themselves with the flux, and when the flux changes directions, the water molecules rotate to realign themselves. Alternating between flux directions due to the alternating cycle causes the water molecules to flip back and forth generating heat in the process. At the 24 GHz frequency, molecular resonance occurs and the water molecules spin continuously instead of just vibrating back of forth. A 24 GHz frequency best heats water vapor. Lower frequencies may preferentially heat liquid water.

Figure 8:
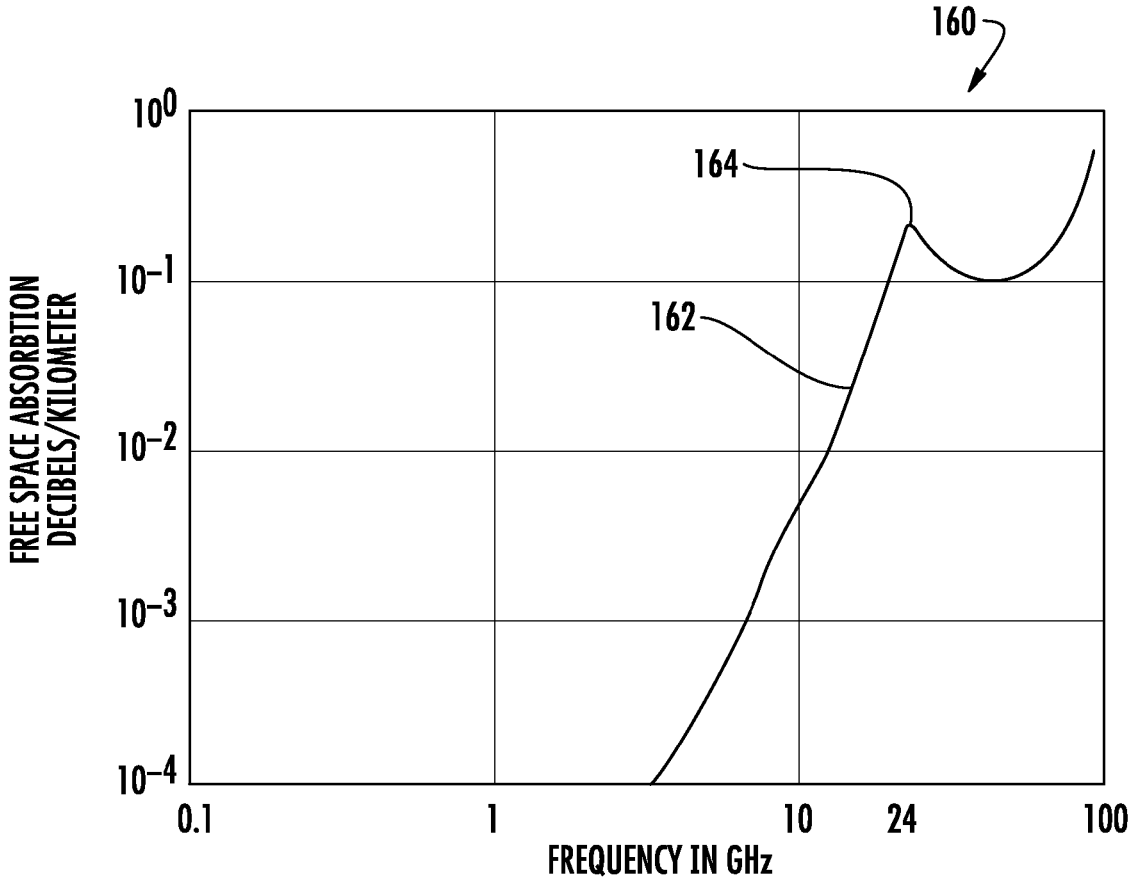
FIG. 8 (PRIOR ART)
FIG. 8 is a plot illustrating the absorption of microwave energy as a function of frequency in accordance with the prior art.

A plot 160 illustrating the absorption of microwave energy as a function of frequency will now be discussed in reference to FIG. 8. Line 162 illustrates the absorption of microwave energy as a function of frequency. Local maxima 164 corresponds to a maximum absorption frequency corresponding to the debye resonance and 24 GHz radio frequency. Plot 160 is for standard atmosphere. The absorption rate in a steam filled injector 10 is of course much higher. However, the response shape of the water molecule is unchanged. The preferred operating frequency of the steam filled injector 10 may be between $c/nd<F<24$ GHz, where c is the speed of light in meters/second, and d is the inner diameter of the injector 10. The lower cutoff frequency of a cylindrical waveguide corresponds to c/nd and 24 GHz is the debye resonance of water. A frequency of 24 Ghz may produce a drier steam, whereas lower frequencies may produce a moister steam.

With vapor only sections in the tubular injector 10, as indicated by reference 15, there is no appreciable heating by the RF energy 42. In contrast, if condensation 13 starts to form within a condensation section of the tubular injector 10, as indicated by reference 17, there is active heating.

As discussed above, the spaced apart steam injector slots 90 are sized to allow steam 12 to pass into the subterranean formation 30, while containing the RF energy 42 within the tubular injector 10 to heat the steam as it condenses 13. The lengths L of the steam injector slots 90 are to be defined by the following formula:

$$L<c/(10f\sqrt{\in r}) \quad (1)$$

where c is the speed of light in meters per second; f is the operating frequency in hertz, and $\in_r$ is the relative permittivity of the payzone or subterranean formation 30.

Stated differently, the formula provides that the electrical field length of the steam injector slots 90 should be less than one tenth of the radio wavelength in the payzone or subterranean formation 30. For example, the steam injector slots 90 may have a length within a range of 0.001λ to 0.10λ, wherein the RF energy source 70 has the operating wavelength λ. The steam injector slots 90 may also be referred to as evanescent steam injector slots meaning that the RF energy 42 will not propagate therefrom.

Figure 9:
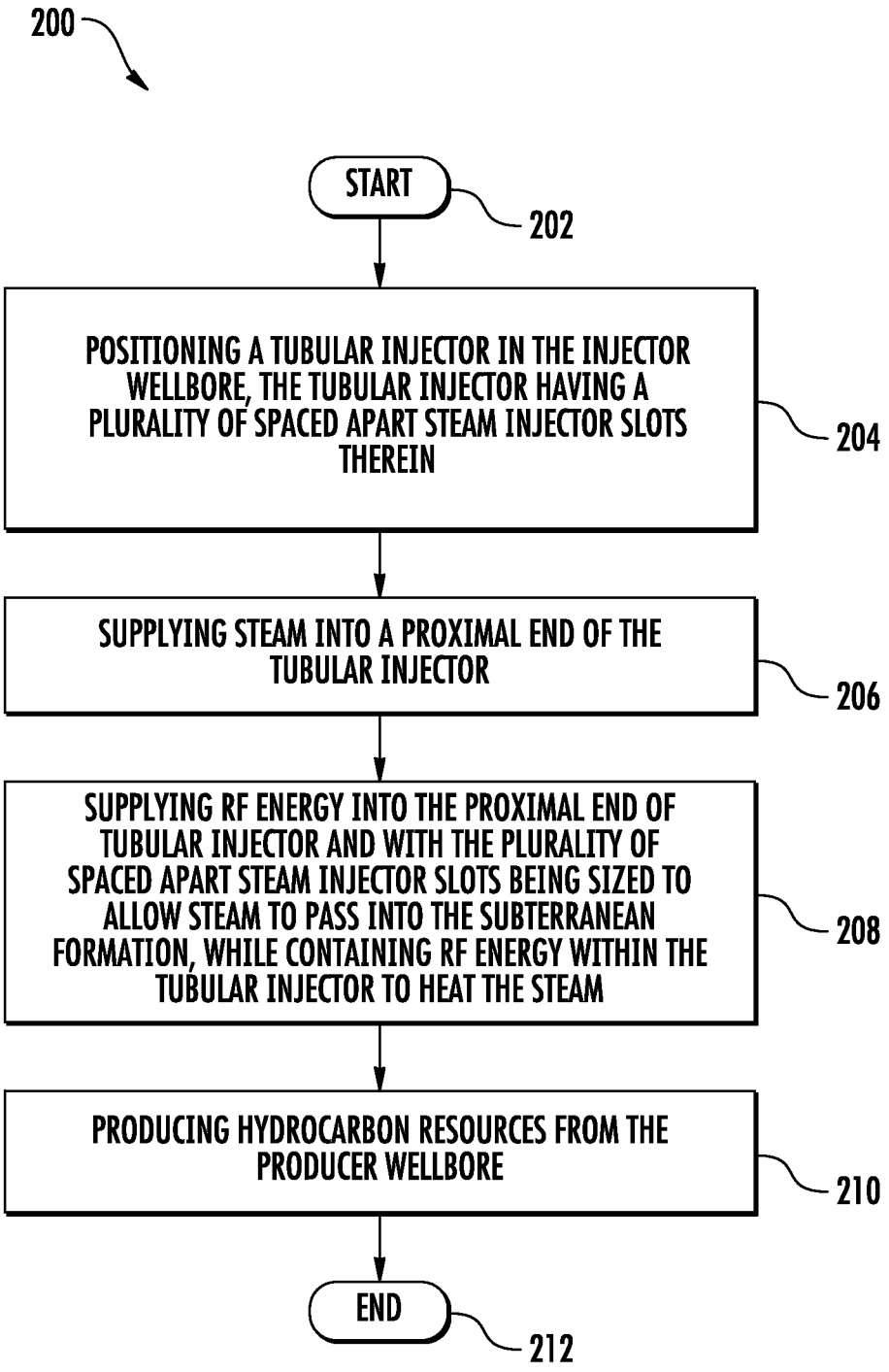
FIG. 9 is a flowchart illustrating a method for hydrocarbon resource recovery in a subterranean formation having an injector wellbore and a producer wellbore therein in accordance with the present invention.

A flowchart 200 illustrating a method for hydrocarbon resource recovery in a subterranean formation 30 having an injector wellbore and a producer wellbore therein will now be discussed in reference to FIG. 9. From the start (Block 202), the method comprises positioning a tubular injector 10 in the injector wellbore at Block 204, with the tubular injector having a plurality of spaced apart steam injector slots 90 therein. Steam 12 is supplied into a proximal end 16 of the tubular injector 10 at Block 206. RF energy 42 is supplied into the proximal end 16 of the tubular injector at Block 208. The spaced apart steam injector slots 90 are sized to allow steam 12 to pass into the subterranean formation 30, while containing RF energy 42 within the tubular injector 10 to heat the steam as it condenses. Hydrocarbon resources may then be produced from the producer wellbore at Block 210. The method ends at Block 212.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A hydrocarbon resource recovery system for a subterranean formation having an injector wellbore and a producer wellbore therein, the hydrocarbon resource recovery system comprising:

a tubular producer positioned in the producer wellbore;

a tubular injector positioned in the injector wellbore;

a steam source coupled to a proximal end of said tubular injector; and a radio frequency (RF) energy source coupled to the proximal end of said tubular injector, said RF energy source comprising first and second magnetrons;

a coupling arrangement between said first and second magnetrons and the proximal end of said tubular injector;

said tubular injector having a plurality of spaced apart steam injector slots sized to allow steam to pass into the subterranean formation, while containing RF energy within said tubular injector to heat the steam.

2. The hydrocarbon resource recovery system according to claim 1 wherein said RF energy source is configured to generate circularly polarized RF energy.

3. The hydrocarbon resource recovery system according to claim 1 wherein the proximal end of said tubular injector is circular; and wherein said coupling arrangement comprises:

a circular-to-rectangular transition having a circular opening coupled to the circular proximal end of said tubular injector, and a rectangular opening;

a rectangular waveguide having a distal end coupled to the rectangular opening of said circular-to-rectangular transition, and a proximal end coupled to said first magnetron;

a first hybrid coupler between said steam source and said rectangular waveguide adjacent the distal end thereof; and a second hybrid coupler between said second magnetron and said rectangular waveguide adjacent the proximal end thereof.

4. The hydrocarbon resource recovery system according to claim 3 wherein said coupling arrangement further comprises a pressure bulkhead within said rectangular waveguide between said first and second hybrid couplers.

5. The hydrocarbon resource recovery system according to claim 1 wherein said RF energy source has an operating frequency within a range of 400 MHz to 24 GHz.

6. The hydrocarbon resource recovery system according to claim 1 wherein said RF energy source is configured to generate waste heat coupled to said steam source.

7. A hydrocarbon resource recovery system for a subterranean formation having an injector wellbore therein, the hydrocarbon resource recovery system comprising:

a tubular injector positioned in the injector wellbore;

a steam source coupled to a proximal end of said tubular injector; and a radio frequency (RF) energy source coupled to the proximal end of tubular injector and configured to generate circularly polarized RF energy within said tubular injector, said RF energy source comprising first and second magnetrons;

a coupling arrangement between said first and second magnetrons and the proximal end of said tubular injector;

said tubular injector having a plurality of spaced apart steam injector slots sized to allow steam to pass into the subterranean formation, while containing RF energy within said tubular injector to heat the steam.

8. The hydrocarbon resource recovery system according to claim 7 wherein the proximal end of said tubular injector is circular; and wherein said coupling arrangement comprises:

a circular-to-rectangular transition having a circular opening coupled to the circular proximal end of said tubular injector, and a rectangular opening;

a rectangular waveguide having a distal end coupled to the rectangular opening of said circular-to-rectangular transition, and a proximal end coupled to said first magnetron;

a first hybrid coupler between said steam source and said rectangular waveguide adjacent the distal end thereof; and a second hybrid coupler between said second magnetron and said rectangular waveguide adjacent the proximal end thereof.

9. The hydrocarbon resource recovery system according to claim 8 wherein said coupling arrangement further comprises a pressure bulkhead within said rectangular waveguide between said first and second hybrid couplers.

10. The hydrocarbon resource recovery system according to claim 7 wherein said RF energy source has an operating frequency within a range of 400 MHz to 24 GHz.

11. The hydrocarbon resource recovery system according to claim 7 wherein said RF energy source is configured to generate waste heat coupled to said steam source.

12. A method for hydrocarbon resource recovery in a subterranean formation having an injector wellbore and a producer wellbore therein, the method comprising:

positioning a tubular injector in the injector wellbore, the tubular injector having a plurality of spaced apart steam injector slots therein;

supplying steam into a proximal end of the tubular injector;

supplying radio frequency (RF) energy into the proximal end of tubular injector and with the plurality of spaced apart steam injector slots being sized to allow steam to pass into the subterranean formation, while containing RF energy within the tubular injector to heat the steam, and with supplying RF energy comprising positioning a coupling arrangement between first and second magnetrons and the proximal end of the tubular injector; and producing hydrocarbon resources from the producer wellbore.

13. The method according to claim 12 wherein supplying RF energy comprises supplying circularly polarized RF energy.

14. The method according to claim 12 wherein the proximal end of the tubular injector is circular; and wherein the coupling arrangement comprises:

a circular-to-rectangular transition having a circular opening coupled to the circular proximal end of the tubular injector, and a rectangular opening;

a rectangular waveguide having a distal end coupled to the rectangular opening of the circular-to-rectangular transition, and a proximal end coupled to the first magnetron;

a first hybrid coupler between the steam source and the rectangular waveguide adjacent the distal end thereof; and a second hybrid coupler between the second magnetron and the rectangular waveguide adjacent the proximal end thereof.

15. The method according to claim 14 wherein the coupling arrangement further comprises a pressure bulkhead within the rectangular waveguide between the first and second hybrid couplers.

16. The method according to claim 12 wherein supplying RF energy comprises supplying RF energy at an operating frequency within a range of 400 MHz to 24 GHz.

17. The method according to claim 12 wherein supplying RF energy comprises supplying RF energy and generating waste heat used for supplying steam.

18. The method according to claim 12 wherein the RF energy is supplied at a water vapor resonance frequency of 24 GHz.

* * * * *